US007207968B1

(12) United States Patent
Harcinske

(10) Patent No.: US 7,207,968 B1
(45) Date of Patent: Apr. 24, 2007

(54) DRINKING DISPENSER FOR BEDRIDDEN PATIENTS

(76) Inventor: John C. Harcinske, 5927 Burnett Rd., Manville, TX (US) 77578

( * ) Notice: Subject to any disclaimer, the term of this patent is extended or adjusted under 35 U.S.C. 154(b) by 731 days.

(21) Appl. No.: 10/266,265

(22) Filed: Oct. 7, 2002

(51) Int. Cl.
*A61J 7/00* (2006.01)
*B65D 83/00* (2006.01)

(52) U.S. Cl. ..... 604/77; 604/78; 215/387

(58) Field of Classification Search ..... 604/30, 604/31, 33, 34, 77, 78, 79, 93.01, 257, 262, 604/264, 275, 278; 220/705, 714, 715; 215/387, 215/388, 389; 222/529, 185.1, 504
See application file for complete search history.

(56) References Cited

U.S. PATENT DOCUMENTS 2,756,740 A * 7/1956 Deane ..... 604/77
2,969,064 A * 1/1961 Metz ..... 604/77
3,165,241 A * 1/1965 Curry ..... 222/490
4,193,197 A * 3/1980 Kuris et al. ..... 433/82
4,702,448 A * 10/1987 LoJacono et al. ..... 248/227.3
4,966,580 A * 10/1990 Turner et al. ..... 604/67
5,484,405 A * 1/1996 Edstrom, Sr. ..... 604/77

* cited by examiner

*Primary Examiner*—Kevin C. Sirmons
*Assistant Examiner*—Elizabeth MacNeill
(74) *Attorney, Agent, or Firm*—Kenneth A. Roddy

(57) ABSTRACT

A gravity-fed drinking dispenser for unassisted self-administration of liquids by a bedridden user includes a non-pressurized liquid container adapted to be positioned above the user's head, a flexible tubing assembly connected therewith with a mouthpiece at its free end, and a normally closed solenoid valve between the container and the mouthpiece which, when opened, allows liquid to flow by gravity to the mouthpiece. A low-voltage D.C. electrical source connected with the solenoid valve supplies direct current thereto. Operation of the solenoid valve is controlled by an ergonomic pressure-sensitive microswitch connected between the power source and the solenoid valve, which has a generally oval-shaped housing with a bulbous upper portion shaped to receive the palm of the user and allow the user to put their fingers around it and actuate the microswitch by applying light pressure thereto for unassisted self-administration of liquids.

3 Claims, 3 Drawing Sheets

DRINKING DISPENSER FOR BEDRIDDEN PATIENTS

BACKGROUND OF THE INVENTION

1. Field of the Invention

This invention relates generally to drinking devices for bedridden persons and, more particularly, to a drink dispenser having a solenoid valve controlled by an ergonomic switch for unassisted drinking by bedridden persons having limited use of their arms, hands, and/or limited body movement.

2. Brief Description of the Prior Art

Many times a bedridden patient must serve themselves with water, juices, or other liquids. In some cases the patient's condition may make them entirely dependent upon other persons for their basic needs, including drinking liquids. For example, a person may be too weak to lift and manipulate, or too unsteady to regulate, a cup or glass filled with liquids or the person may not have the necessary range of motion to reach a container on a bedside table.

The common practice in most hospitals, nursing homes, and in-home patient care settings requires another person to serve liquids to the patent by filling a glass from a larger container which is often located on a table out of reach of the patient. Usually the container is an open plastic pitcher. The server must hand the filled glass to the patient, wait for the patient to drink, and then replace the glass on the table (which may be out of reach). The open pitcher may also be left on the table for extended periods of time and it contents are susceptible to contamination by airborne contaminants, and spillage.

There are several patents that disclose various drinking devices for administering liquids to a bedridden person from a container.

Deane, U.S. Pat. No. 2,756,740 discloses drinking device for bedridden persons comprising a bottle and tubing assembly having an elongated mouthpiece which is placed in the mouth of the user. The mouthpiece contains a manually operated spring biased plunger valve that is activated by the user depressing the plunger to supply liquid. This device requires the user to lift the mouthpiece, place the end of the mouthpiece between his or her lips, and have sufficient finger strength to grip the mouthpiece and depress the plunger against the spring force.

Metz, U.S. Pat. No. 2,969,064 discloses a drinking tube device for bedridden persons comprising a bottle and tubing assembly having a clamping mouthpiece that surrounds the free end of the tubing and is placed in the mouth of the user. The clamping mouthpiece is resiliently biased to a normally closed position to pinch the end of the tubing and is opened by the user's jaw pressure by biting down on the mouthpiece to supply liquid.

Elmore, U.S. Pat. No. 3,587,934 discloses a drinking device for bedridden persons comprising a flexible bag containing liquid housed in a thermally insulated container connected with a tubing assembly having a mouthpiece at its free end, which is placed in the mouth of the user. The mouthpiece contains a spring biased plunger valve that is activated by the user depressing the plunger with his or her tongue to supply liquid.

Turner et al, U.S. Pat. No. 4,813,933 and Turner, U.S. Pat. No. 4,966,580 disclose a device for administering oral fluid to a patient from a container. A nipple connected to the container by a tube is held on the patient's tongue. A valve in the nipple or in the opens in response to the patient sucking or pressing the nipple to initiate a flow of fluid in the tube. In U.S. Pat. No. 4,966,580, a detector responds to this flow and switches on a peristaltic pump for a period determined by the setting of a controller to deliver positively a suitable bolus of 2 to 6 ml to the patient. To give the patient time to swallow the bolus, the detector is inhibited for a predetermined delay period after termination of the bolus and over the same delay period, the tube remains pinched or clamped.

Turner et al, U.S. Pat. No. 5,057,077 discloses a device for administering oral fluid from a reservoir to a patient from a container. A mouthpiece with a nipple or diaphragm at its rear end is connected to the container by a tube and is held in the patient's mouth. The nipple or diaphragm is activated by the user's tongue. A fluid flow control ball valve connected in the tube via inlet and outlet ports comprises a hollow cylindrical housing containing a ball valve element freely reciprocal therein that serves as a piston to close and open the outlet port. The ball valve is opened when the user squeezes the nipple against his or her palate with the tongue to supply a quantity of liquid and is closed when the tongue pressure is released.

Edstrom, Sr. et al, U.S. Pat. No. 5,484,405, discloses a drinking device for handicapped persons that is semi-permanently positionable at a location permitting access to the device by the mouth of the user; and is activated by the mouth of the user to continuously supply liquid to the user upon demand using only the user's mouth. The device includes a mouth operated drinking valve the semi-permanent positioning of which for accessibility by the mouth of the user is made possible by a tubing assembly in the form a flexible tube supported by a stiffener which permits the tubing assembly to be readily bent to position the tube and drinking valve as desired and maintains its position after bending.

The present invention is distinguished over the prior art in general, and these patents in particular by a drinking dispenser apparatus for self-administration of liquids by a bedridden user having limited use of their arms, hands, and/or limited body movement. A liquid container adapted to be positioned above the head of a user has a flexible tubing assembly connected in fluid communication with its interior and has a mouthpiece at its free end. A solenoid valve disposed in the tubing assembly between the container and the mouthpiece is connected with a low-voltage electrical power source. An ergonomic low-effort microswitch is connected between the power source and the solenoid valve. The microswitch housing is a generally oval shaped enclosure sized and shaped to receive and support the palm of the user's hand and allow the user to put their fingers around it. A button mounted on the housing receives and supports a finger of the user, or may be squeezed in the hand, and when depressed under very light pressure depresses the stem of the microswitch completing a circuit that energizes the solenoid valve to move its valve element to an open position allowing liquid to flow by gravity from the container to the mouthpiece, and when the finger pressure is released allows the valve element to return to a closed position preventing liquid flow from the container to the mouthpiece. A tube support member may also be provided to hold the mouthpiece in a position within easy reach of the user such that the user may place the mouthpiece in his or her mouth manually or by turning his or her head to one side to place their mouth on the mouthpiece.

SUMMARY OF THE INVENTION

It is therefore an object of the present invention to provide a drinking dispenser for unassisted drinking of liquids by bedridden persons.

It is another object of this invention to provide a drinking dispenser controlled by an ergonomic easily depressible switch for operation by bedridden persons having limited use of their arms, hands, and/or limited body movement.

Another object of this invention is to provide a drinking dispenser controlled by an ergonomic easily depressible switch sized and shaped to receive the palm of the user, similar to a computer mouse, that allows the user to put their fingers around it and operate it by very slight finger pressure of a single finger, or by squeezing in the hand, and provides comfort and gives a greater feeling of control.

Another object of this invention is to provide a drinking dispenser controlled by an ergonomic easily depressible switch, which is sized and shaped to avoid confusion with other switches that may be nearby, such as a nurse call switch, or remote control for a television.

Another object of this invention is to provide a drinking dispenser having a solenoid valve that allows liquid to flow by gravity and does not require pressurization of the liquid container.

Another object of this invention is to provide a drinking dispenser having a solenoid valve that is energized by low voltage polarized direct current to allow liquid to flow by gravity and does not require pressurization of the liquid container.

Another object of this invention is to provide a drinking dispenser having a solenoid valve that is energized by low voltage polarized direct current that allows the user to easily control the quantity of liquid dispensed, and reduces the overall complexity of the device.

Another object of this invention is to provide a drinking dispenser for bedridden persons, which heightens the user's level of independence by permitting the positioning of the mouthpiece at a location that is easily accessible by the mouth of the user.

A further object of this invention is to provide a drinking dispenser for bedridden persons that will eliminate many mundane, non-professional tasks that nursing professionals currently perform, thus freeing more time for the professional patient care aspects of nursing.

A still further object of this invention is to provide a drinking dispenser for bedridden persons that is simple in construction, inexpensive to manufacture, and rugged and reliable in operation.

Other objects of the invention will become apparent from time to time throughout the specification and claims as hereinafter related.

The above noted objects and other objects of the invention are accomplished by a drinking dispenser apparatus for self-administration of liquids by a bedridden user having limited use of their arms, hands, and/or limited body movement. A liquid container adapted to be positioned above the head of a user has a flexible tubing assembly connected in fluid communication with its interior and has a mouthpiece at its free end. A solenoid valve disposed in the tubing assembly is connected with a low-voltage electrical power source. An ergonomic low-effort microswitch is connected between the power source and the solenoid valve. The microswitch housing is a generally oval shaped enclosure sized and shaped to receive and support the palm of the user's hand and allow the user to put their fingers around it. A button mounted on the housing receives and supports a finger of the user, or may be squeezed in the hand, and when depressed under very light pressure depresses the stem of the microswitch completing a circuit that energizes the solenoid valve to move its valve element to an open position allowing liquid to flow by gravity from the container to the mouthpiece, and when the finger pressure is released allows the valve element to return to a closed position preventing liquid flow from the container to the mouthpiece. A tube support member may also be provided to hold the mouthpiece in a position within easy reach of the user such that the user may place the mouthpiece in his or her mouth manually or by turning his or her head to one side to place their mouth on the mouthpiece.

DESCRIPTION OF THE PREFERRED EMBODIMENT

Figure 1:
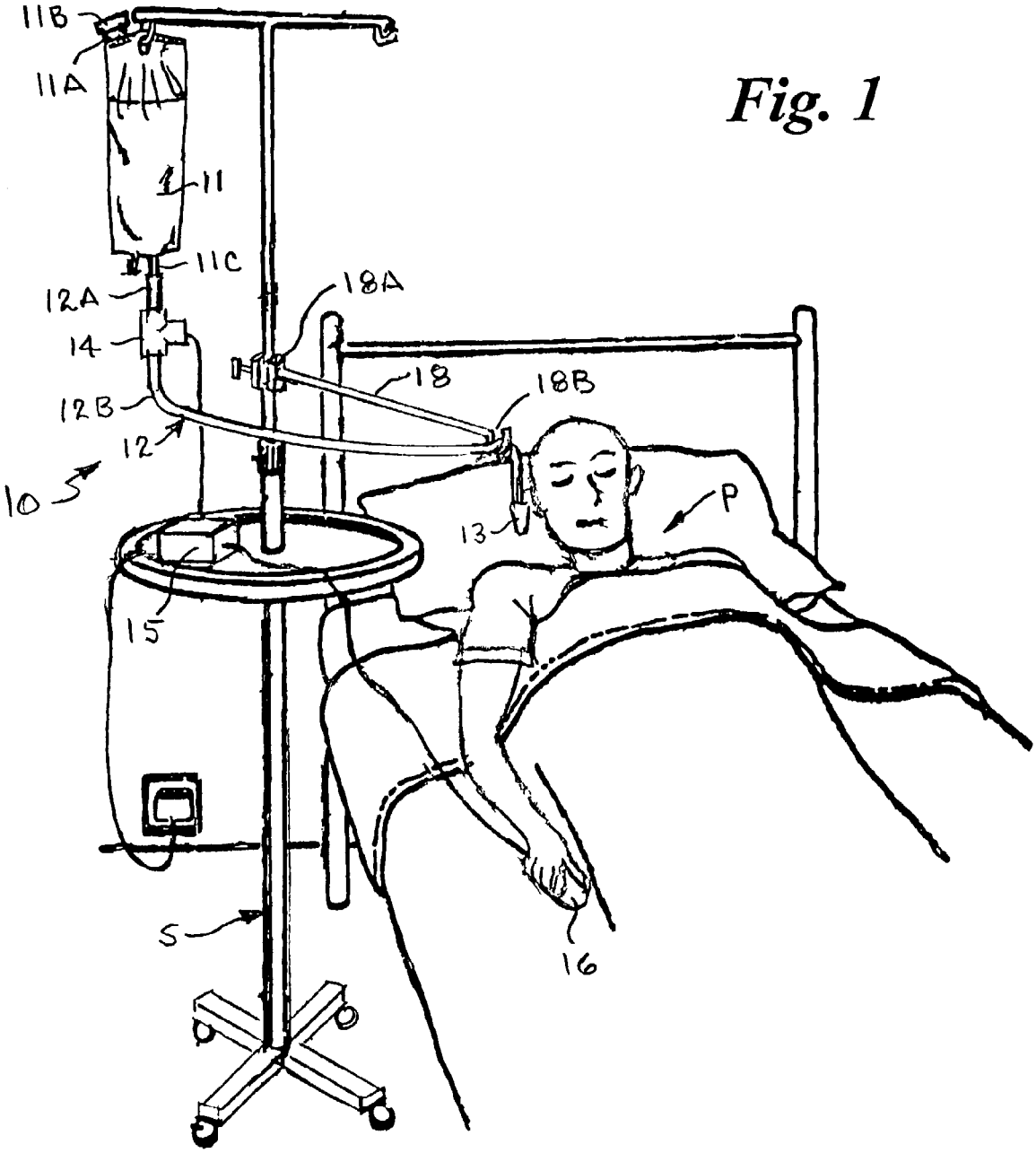
FIG. 1 is a perspective view of the drinking dispenser system in accordance with the present invention.

Referring to the drawings by numerals of reference, there is shown in FIG. 1, the main components of a preferred drink dispensing apparatus 10. The drink dispensing apparatus 10 includes a liquid container 11, a tubing assembly 12 with a mouthpiece 13 connected at the free end thereof, a solenoid valve 14 connected with an electrical low voltage power source 15, and an ergonomic switch 16 connected with the solenoid valve for controlling its operation. The present drinking dispenser 10 is designed to supply water or other liquid from the container 11 by gravity to the mouth of a user P when the solenoid valve 14 is actuated by the ergonomic switch 16.

The preferred liquid container 11 is a non-pressurized flexible collapsible bag having a fill opening 11A at an upper end with a removable cap 11B for covering the opening, and an outlet fitting 11C, such as a hose barb, on a lower end. The liquid container 11 may be mounted on a wall or, as illustrated in FIG. 1, a portable or stationary I.V. stand S, or any other suitable support. The liquid container 11 may be refillable and disposable after one or more uses by the same user.

Figure 2:
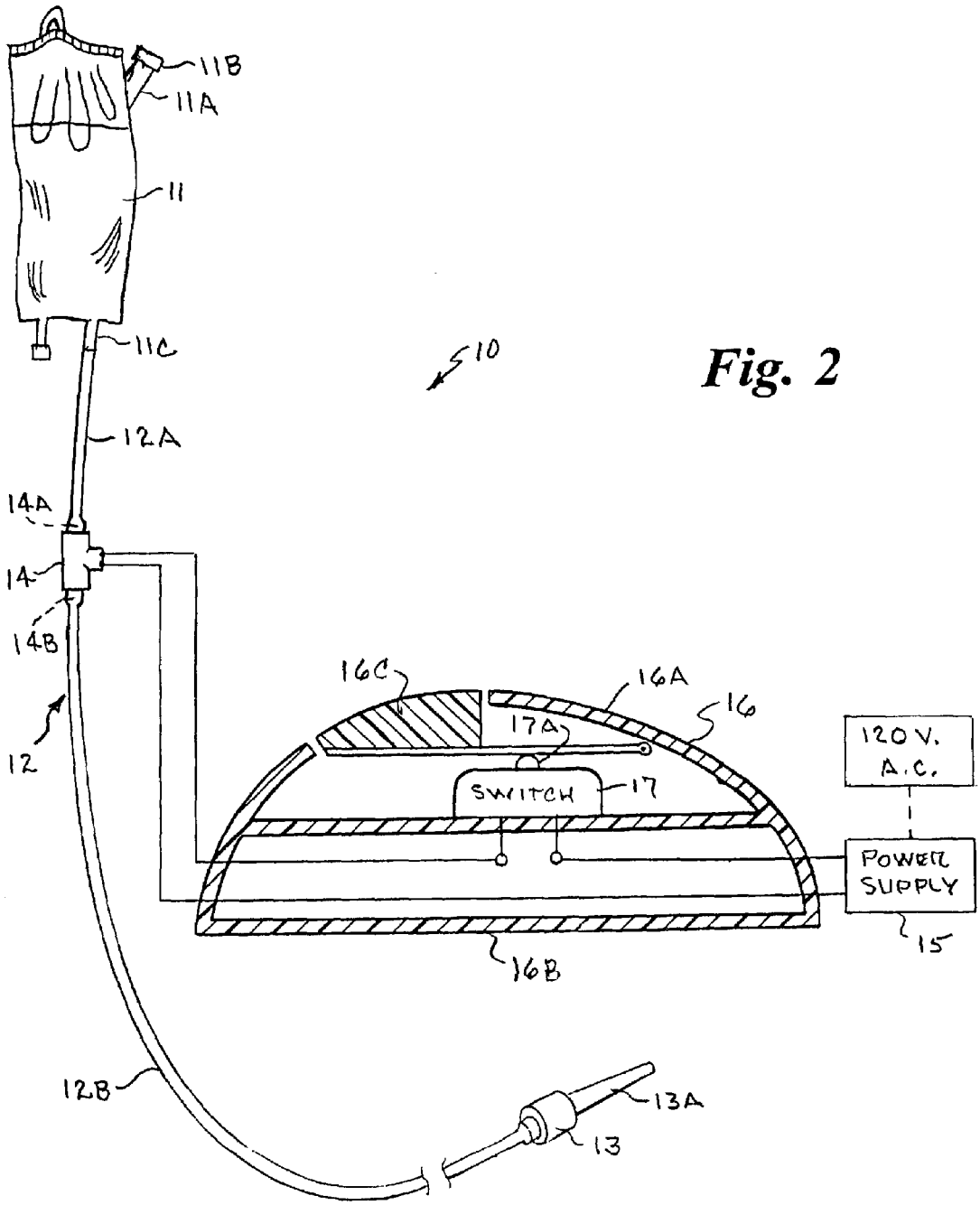
FIG. 2 is a schematic diagram of the circuitry of the drinking dispenser system, showing the ergonomic switch in cross section.
Figure 3:
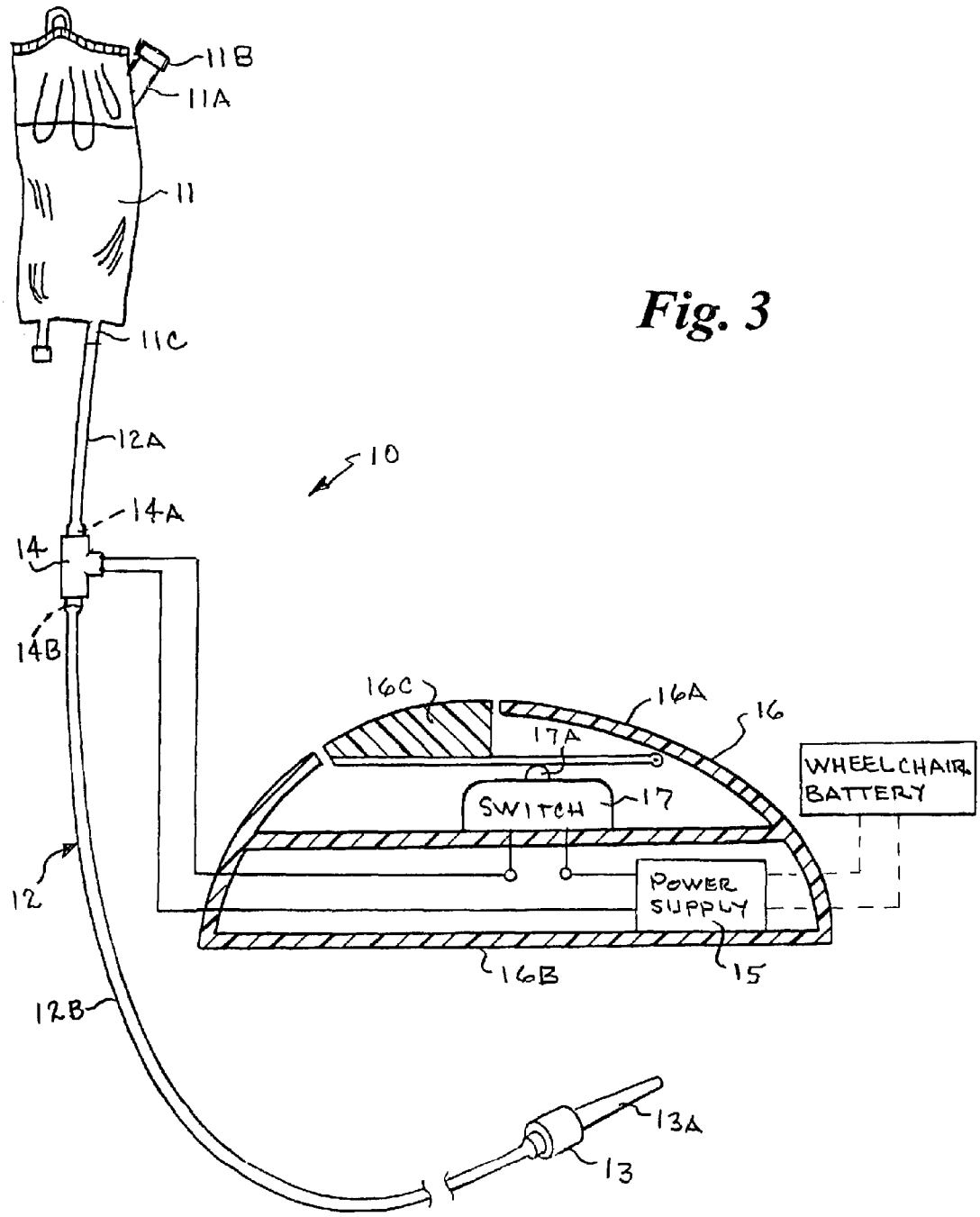
FIG. 3 is a schematic diagram of the circuitry of the drinking dispenser system, showing an alternate embodiment of the ergonomic switch in cross section.

As best seen in FIGS. 2 and 3, the tubing assembly 12 includes a first section of flexible tubing 12A having a first end releasably connected to the outlet fitting 11C of the container 11 and a second end connected to an inlet fitting 14A of the solenoid valve 14, and a second section of flexible tubing 12B having a first end connected to an outlet fitting 14B of the solenoid valve. The solenoid valve 14 has body with a plunger mounted therein which is reciprocated by the actuating coil of the solenoid to open and close fluid flow through the solenoid valve body. The solenoid valve 14 may also incorporate a "three way" valve that allows residual liquid remaining in the tube downstream of the solenoid to be sucked out by the user through the mouthpiece after the user has released the switch and the solenoid has closed.

The mouthpiece 13 is connected to the second end of the second section of tubing 12B that extends from the solenoid valve 14. The mouthpiece 13 is a disposable elongate tubular member having a central bore with forward end 13A sized and shaped to fit comfortably in the user's mouth, and a hose barb 13B at its rearward end which is releasably connected to the free end of the second section of tubing.

In a preferred embodiment, solenoid valve 14 is operated by low voltage D.C. power and the power source 15 may be a rectifier, certified to safely operate in a sterile, oxygen rich environment, that is plugged into a standard 120-volt A.C. wall outlet and converts the alternating current to low-voltage direct current whereby the solenoid valve 14 is energized with polarized direct current (FIG. 2). Alternatively, the power source 15 may be a battery or battery pack contained in the housing 16A of the ergonomic switch 16 (FIG. 3), or a remote portable battery or battery pack. The solenoid valve 14 may also be operated by low voltage D.C. power using the power supply of a wheelchair, as indicated in dashed line in FIG. 3.

The ergonomic switch 16 is a low-effort electrical switch, similar to a computer mouse. As best seen in FIGS. 2 and 3, the switch 16 has a generally oval shaped housing 16A with a bulbous top portion and may have a generally flat bottom wall 16B. A button 16C is pivotally mounted at the top of the switch housing 16A to receive and support a finger of the user. A microswitch 17 is supported in the switch housing 16A beneath the button 16C and is electrically connected in series between one terminal of the low voltage power source 15 and to one contact of the coil of the solenoid valve 14. The other contact of the solenoid coil is connected to the other terminal of the low voltage power source 15. Very light finger pressure on the button 16C, or light pressure exerted by a users hand wrapped around the enclosure, will depress the stem 17A of the microswitch 17 and activate the plunger of the solenoid to allow liquid to flow, by gravity, through the solenoid from the container to the mouthpiece 13. The patient may increase the flow rate slightly by sucking on the mouthpiece 13. When the finger pressure is released, the solenoid plunger will close to prevent flow of the liquid. The solenoid may incorporate a "three way" valve that allows residual liquid remaining in the tube downstream of the solenoid in tube 12B to be sucked out by the user through the mouthpiece after the user has released the switch and the solenoid has closed.

The flat bottom 16A of the switch 16 allows the switch to be placed in an easily accessible position on a bed, similar to a nurse call switch. The switch housing 16B is sized and shaped, similar to a computer mouse, to receive the palm of the user and to allow the user to put their fingers around it, thus, providing comfort and giving a greater feeling of control. The ergonomic switch 16 may also be lightly squeezed in the hand of the user to depress the button 16C. The button 16C may also be pivotally mounted at other locations on the switch housing 16A to facilitate activation by light squeezing or finger pressure. Because of its ovoid bulbous shape, it will also avoid confusion with other switches that may be nearby, such as a nurse call switch, a bed adjustment switch, or remote control for a television.

A tube support member 18 (FIG. 1) may also be provided to hold the mouthpiece 13 in a position within easy reach of the patient when not in use. The tube support 18 is a rigid rod having a clamp 18A at one end for connection an I.V. stand, and a U-shaped hook 18B at its outer end which supports the mouthpiece 13, or a portion of the flexible tubing 12 adjacent to the mouthpiece. Thus, the mouthpiece 13 is positioned within easy reach of the user, either by the user manually placing it in his or her mouth, or by simply turning his or her head to one side to place their mouth on the mouthpiece. The tube support 18 may also be clamped to a wheelchair or wheelchair structural member.

The mouthpiece 13 is disposable to prevent infection and replaceable mouthpieces of different colors may be provided to identify different types or different flavors of liquids.

It should be understood from the foregoing, that an attendant is required only to fill the container 11, to initially position the tubing assembly 12 and the mouthpiece 13 at a location which is accessible by the mouth of the user, and to place the palm of the hand of the user on the ergonomic switch 16. The user is then capable of obtaining liquids upon demand, without further assistance from the attendant for extended periods of time, by merely depressing the button of the switch with his or her finger or slightly squeezing the switch.

While this invention has been described fully and completely with special emphasis upon a preferred embodiment, it should be understood that within the scope of the appended claims the invention may be practiced otherwise than as specifically described herein.

The invention claimed is:

1. A gravity-flow drinking dispenser apparatus for unassisted self-administration of liquids by a bedridden user, comprising:

a non-pressurized container for holding a quantity of liquid and adapted to be positioned above the head of a user;

a flexible tubing assembly connected in fluid communication with the container interior and having a free end;

a mouthpiece connected at said tubing assembly free end adapted to be received in the mouth of the user and having an interior passageway through which liquids can flow;

a solenoid valve disposed in said tubing assembly between said container and said mouthpiece and having a valve element movable between a closed position preventing liquid flow from said container to said mouthpiece and an open position allowing liquid to flow by gravity from said container to said mouthpiece;

a low-voltage direct current electrical power source connected with said solenoid valve for supplying polarized low-voltage direct current thereto; and an ergonomic low-effort pressure-sensitive microswitch electrically connected in series between a first terminal of said low-voltage direct current electrical power source and a first contact of said solenoid valve for allowing the user to control the operation of said solenoid valve;

said ergonomic low-effort pressure-sensitive microswitch having a generally oval-shaped housing with a generally flat bottom wall and a bulbous upper portion sized and shaped to receive the palm of the user and allow the user to put their fingers around it and actuate said microswitch by applying light pressure thereto and thereby control the operation of said solenoid valve for unassisted self-administration of liquids.

2. The drinking dispenser apparatus according to claim 1, wherein said ergonomic low-effort pressure-sensitive microswitch has a button mounted on said housing upper portion to receive and support a finger of the user, and an actuator stem beneath said button which when depressed under very light finger pressure will complete a circuit to energize said solenoid valve to move said valve element to said open position and allow liquid to flow by gravity from said container to said mouthpiece, and when the finger pressure is released allow said valve element to return to said closed position preventing liquid flow from said container to said mouthpiece.

3. The drinking dispenser apparatus according to claim 1, wherein said ergonomic low-effort pressure-sensitive microswitch has a button mounted on said housing to receive the palm of the hand of the user and capable of being depressed by applying light pressure or squeezing said housing by the hand of the user, and an actuator stem beneath said button which when depressed under very light pressure will complete a circuit to energize said solenoid valve means to move said valve element to said open position and allow liquid to flow by gravity from said container to said mouthpiece, and when the pressure is released allow said valve element to return to said closed position preventing liquid flow from said container to said mouthpiece.

* * * * *